US007862010B2

(12) United States Patent
Saura Sotillos

(10) Patent No.: US 7,862,010 B2
(45) Date of Patent: Jan. 4, 2011

(54) HIGH IMPACT RESISTANT BARRIER/FENCE

(76) Inventor: Jorge Antonio Saura Sotillos, Calle Santa Engracia, 72, Madrid (ES) 28010

( * ) Notice: Subject to any disclaimer, the term of this patent is extended or adjusted under 35 U.S.C. 154(b) by 283 days.

(21) Appl. No.: 12/053,767

(22) Filed: Mar. 24, 2008

(65) Prior Publication Data

US 2009/0032791 A1 Feb. 5, 2009

Related U.S. Application Data

(60) Provisional application No. 60/952,620, filed on Jul. 30, 2007.

(51) Int. Cl.
*E04H 17/16* (2006.01)

(52) U.S. Cl. ..... 256/31; 256/1; 256/24; 405/16; 405/284

(58) Field of Classification Search ..... 256/1, 256/11, 12, 13, 24, 31, 35, 36, 65.14; 405/16, 405/19, 284
See application file for complete search history.

(56) References Cited

U.S. PATENT DOCUMENTS

| | | | | | |
|---|---|---|---|---|---|
| 611,659 | A * | 10/1898 | Truax | 256/35 |
| 2,193,425 | A * | 3/1940 | Lake | 405/272 |
| 2,325,260 | A | 7/1943 | May | |
| 4,341,491 | A * | 7/1982 | Neumann | 405/284 |
| 4,677,798 | A | 7/1987 | Phillips | |
| 4,824,282 | A | 4/1989 | Waldecker | |
| 5,336,016 | A | 8/1994 | Baatz | |
| 5,584,599 | A | 12/1996 | Knittel | |
| 5,623,797 | A | 4/1997 | Gravier et al. | |
| 6,264,172 | B1 * | 7/2001 | Ball et al. | 256/31 |
| 6,782,624 | B2 * | 8/2004 | Marsh et al. | 256/11 |
| 6,884,002 | B1 | 4/2005 | Fuller | |
| 7,128,308 | B2 | 10/2006 | Marsh et al. | |
| 2002/0187010 | A1 * | 12/2002 | MacDonald et al. | 405/284 |
| 2007/0257244 | A1 * | 11/2007 | Sallen Rosello et al. | 256/35 |

FOREIGN PATENT DOCUMENTS

| | | | | |
|---|---|---|---|---|
| JP | 04-52324 | * | 2/1992 | 405/284 |
| JP | 04-60022 | * | 2/1992 | 405/284 |
| JP | 05-112937 | * | 5/1993 | 405/284 |

* cited by examiner

*Primary Examiner*—Michael P Ferguson
(74) *Attorney, Agent, or Firm*—Brian D. Smith, P.C.

(57) ABSTRACT

A barrier is disclosed which includes a connected pair of upstanding and equidistantly spaced first and second walls which together define a channel having a bottom and an open top. Dirt or rock fill (or fill of any other non-vegetative material) is poured into or otherwise placed in the channel between the walls to cover the bottom of the channel and at least partially fill the channel. The area of the channel containing the fill may be lined with geo-textile material to help contain the fill.

20 Claims, 6 Drawing Sheets

HIGH IMPACT RESISTANT BARRIER/FENCE

CROSS REFERENCE TO RELATED APPLICATIONS

This application is a nonprovisional application claiming the benefit under 35 USC 119(e) of U.S. provisional application Ser. No. 60/952,620 filed on Jul. 30, 2007.

FIELD OF THE INVENTION

The invention relates to fences and more particularly to barriers which prevent individuals from crossing the barrier, i.e. a pedestrian barriers, as well as barriers for resisting the impact of vehicle crashing into the barrier.

BACKGROUND OF THE INVENTION

While the prior art is replete with fences and barriers of various types, a need remains for a barrier that can prevent individuals from crossing the barrier, i.e. a pedestrian barrier, and at the same time resist vehicle crash impacts. It would also be desirable if such a barrier could be built on virtually any type of terrain and not require concrete or anything else necessary in order to anchor or attach it to the ground.

BRIEF SUMMARY OF THE INVENTION

The present invention addresses the aforementioned concerns by providing a barrier that in its broadest sense includes a connected pair of upstanding and equidistantly spaced first and second walls (typically about 15 to 25 feet high and spaced between about 6 to 12 feet from each other) which together define a channel having an open bottom and an open top. Dirt or rock fill (or fill of any other non-vegetative material) is poured into or otherwise placed in the channel between the walls to cover the open bottom of the channel and at least partially fill the channel. On a 25 foot high barrier typically about 6 to 8 feet of fill would be poured into or placed in the channel of the barrier. Such an amount of fill will successfully resist the impact of most vehicular crashes. It will also be appreciated that such a barrier can be built upon almost all terrain except extremely steep terrain without having to anchor or attach the walls of the barrier to the ground.

In a preferred embodiment, the barrier walls include a plurality of upstanding, parallel and spaced beams which receive a plurality of generally rectangularly shaped mesh panels. Cross beams are also provided for connecting each upstanding beam of the first wall to a corresponding upstanding beam of the second wall. The cross beams are preferably welded (although they could be bolted) to the upstanding beams and in a preferred embodiment a bottom crossbeam connects the bottom edge of an upstanding beam of the first wall to the bottom edge of a corresponding upstanding beam of the second wall. A midsection crossbeam is also preferably provided which connects the upstanding beams at pre-determined points on the sides of said upstanding beams. The midsection crossbeams are also preferably connected to the sides of the upstanding beams so that they are parallel to the bottom crossbeams. On a 25 foot high barrier, the midsection beams would also typically be spaced about 6 to 8 feet above the bottom crossbeams.

Each connected set of beams, i.e. pair of a upstanding beams of the first and second walls which are connected by their respective pair of bottom and midsection beams are referred to herein as a beam section. In a preferred embodiment, the connected beams of each beam section lie in the same plane and the beam sections are parallel to and equidistantly spaced from each so that each pair of upstanding beams receives one rectangularly shaped mesh panel. The beams are preferably I beams which enable the channels of the I-beams to slidably receive the mesh panels. The beam sections are held together with cable, preferably steel cable, which interconnect the beam sections. In addition, the open bottom of the barrier as well as the first six feet (or a pre-determined distance) of the inner facing surfaces of the first and second walls are preferably lined with a geo-textile material to contain the fill. Barbed wire, razor wire, concertina and/or a system of spring-loaded flexible panels may be attached to the top edge of each wall to make it difficult for individuals to scale or otherwise cross the barrier.

BRIEF DESCRIPTION OF THE DRAWINGS

The invention will be more readily understood by reference to the accompanying drawings wherein like reference numerals indicate like elements, and in which.

DETAILED DESCRIPTION OF THE INVENTION

Figure 1:
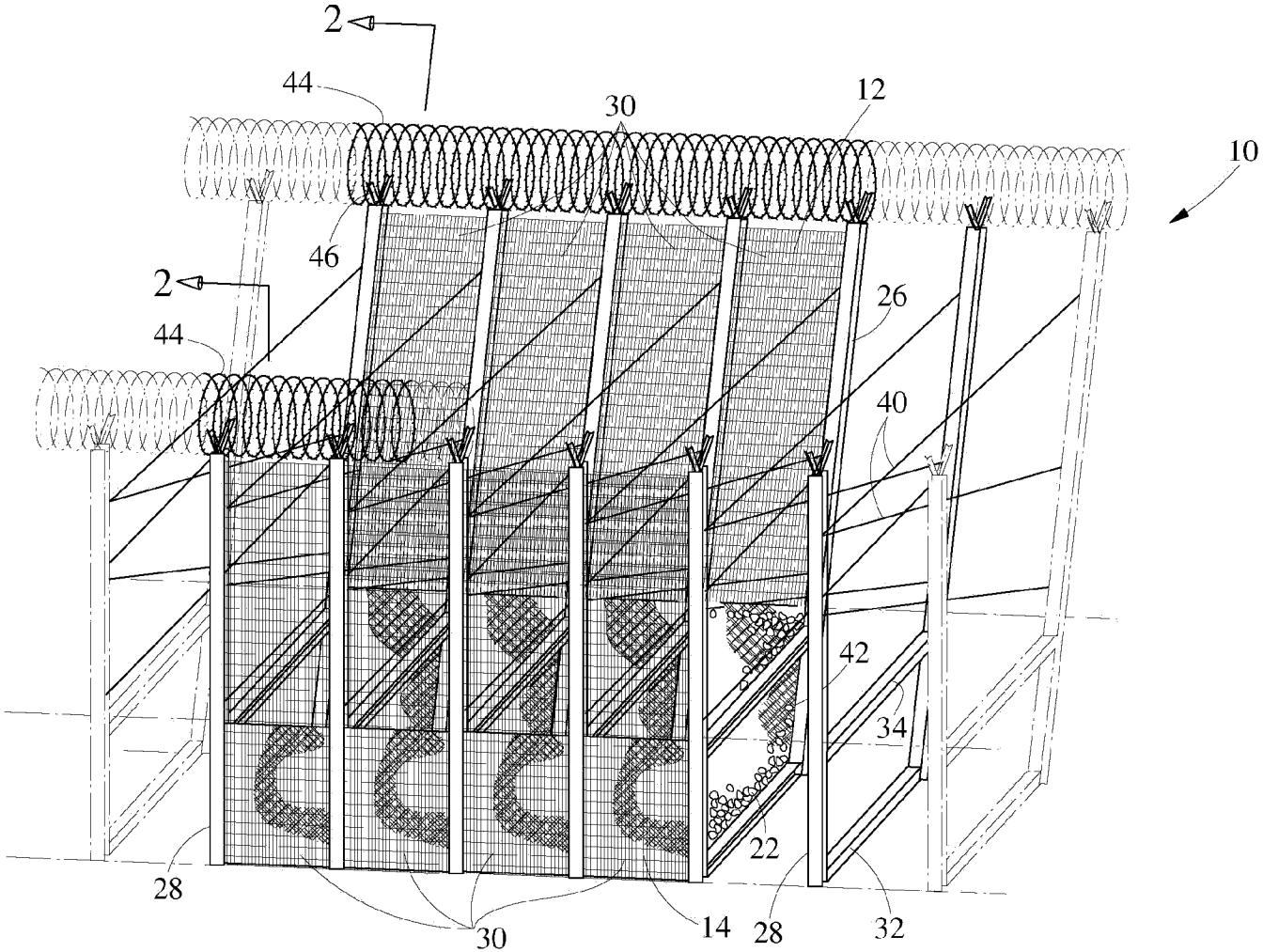
FIG. 1 is a perspective view of a preferred embodiment of the barrier of the present invention.
Figure 2:
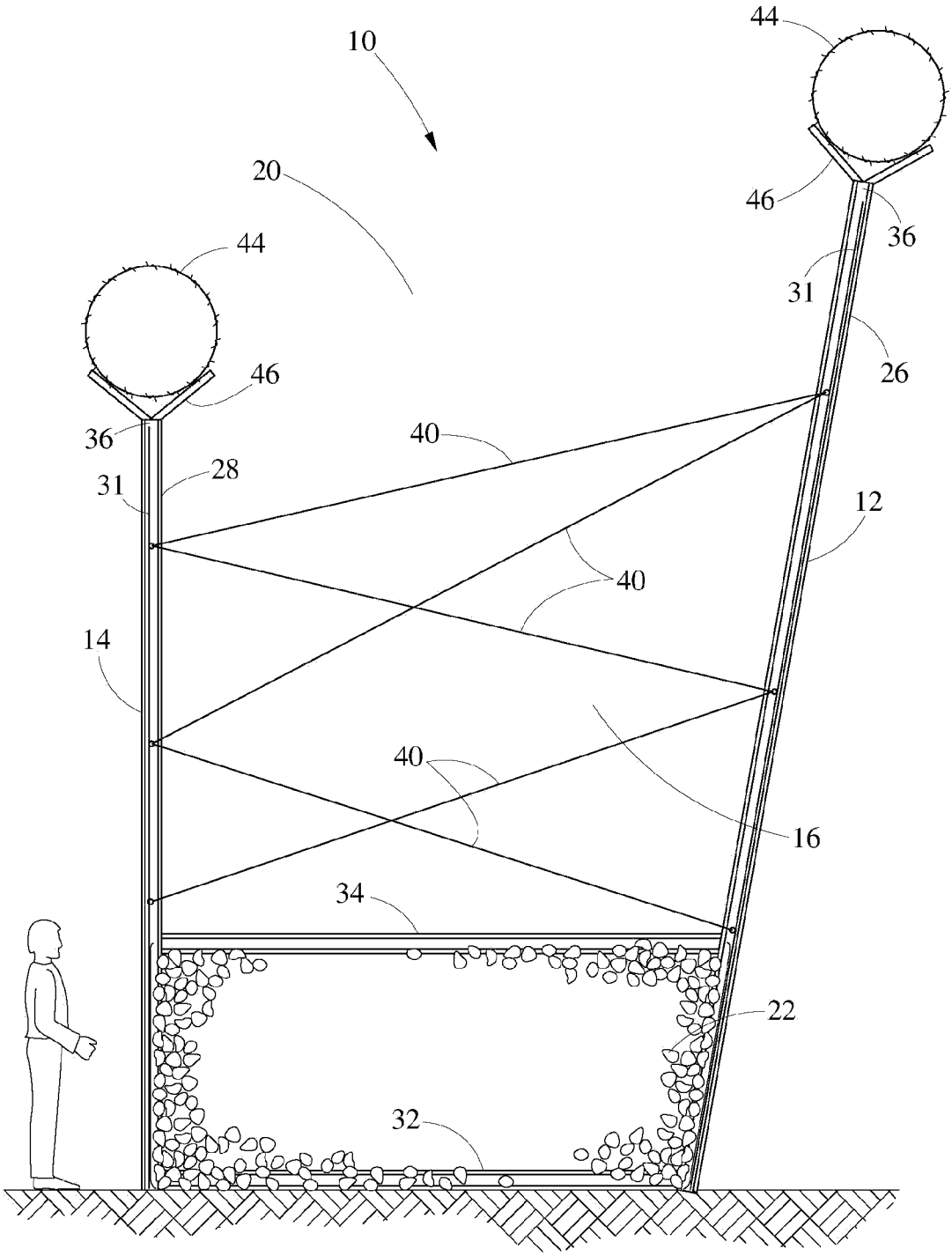
FIG. 2 is a cross-sectional view taken along lines 2-2 of FIG. 1.
Figure 3:
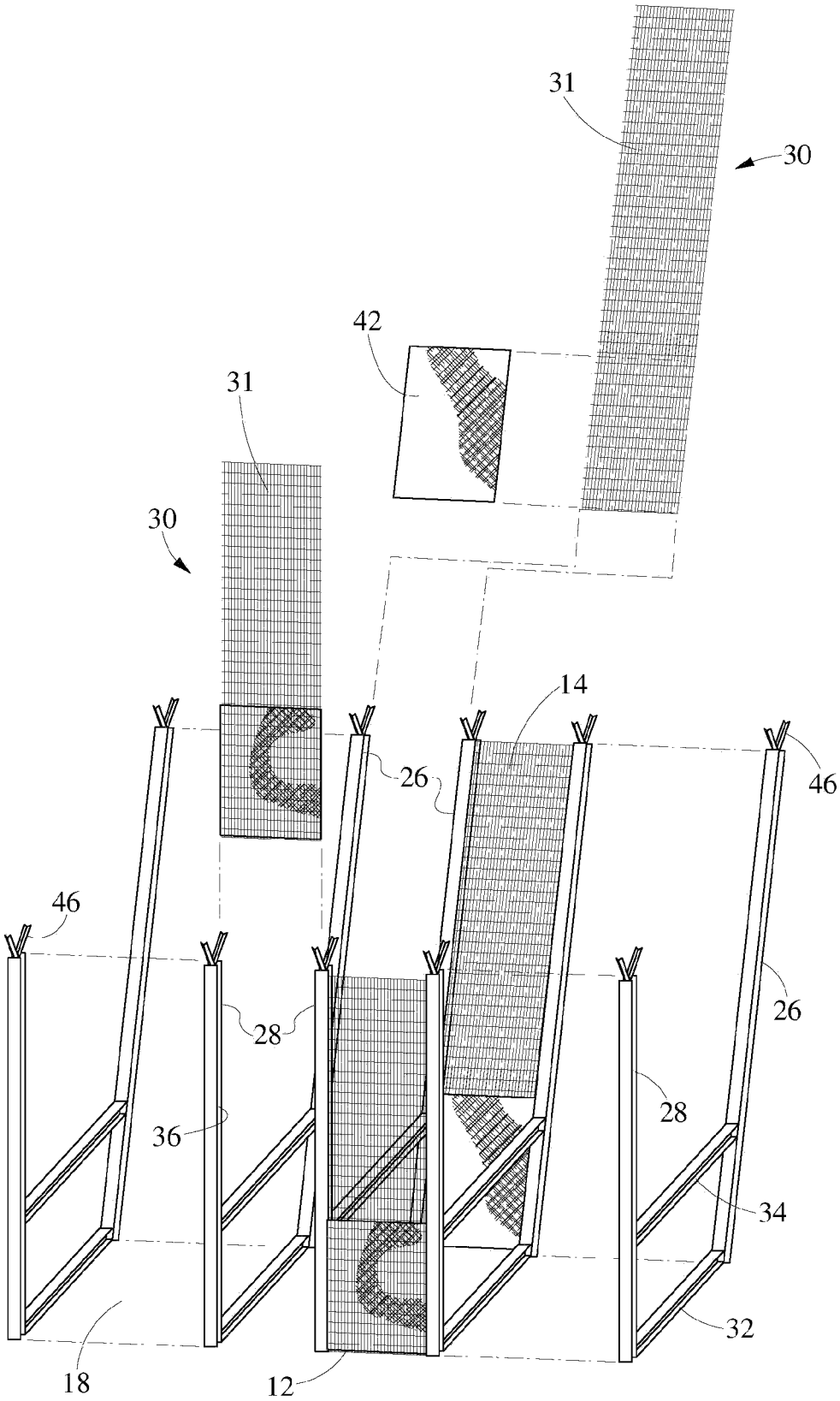
FIG. 3 is an exploded view of the barrier of FIG. 1 showing two mesh panels of the barrier as they would appear before being slidably inserted into the channels of the I-beams of the barrier.
Figure 4:
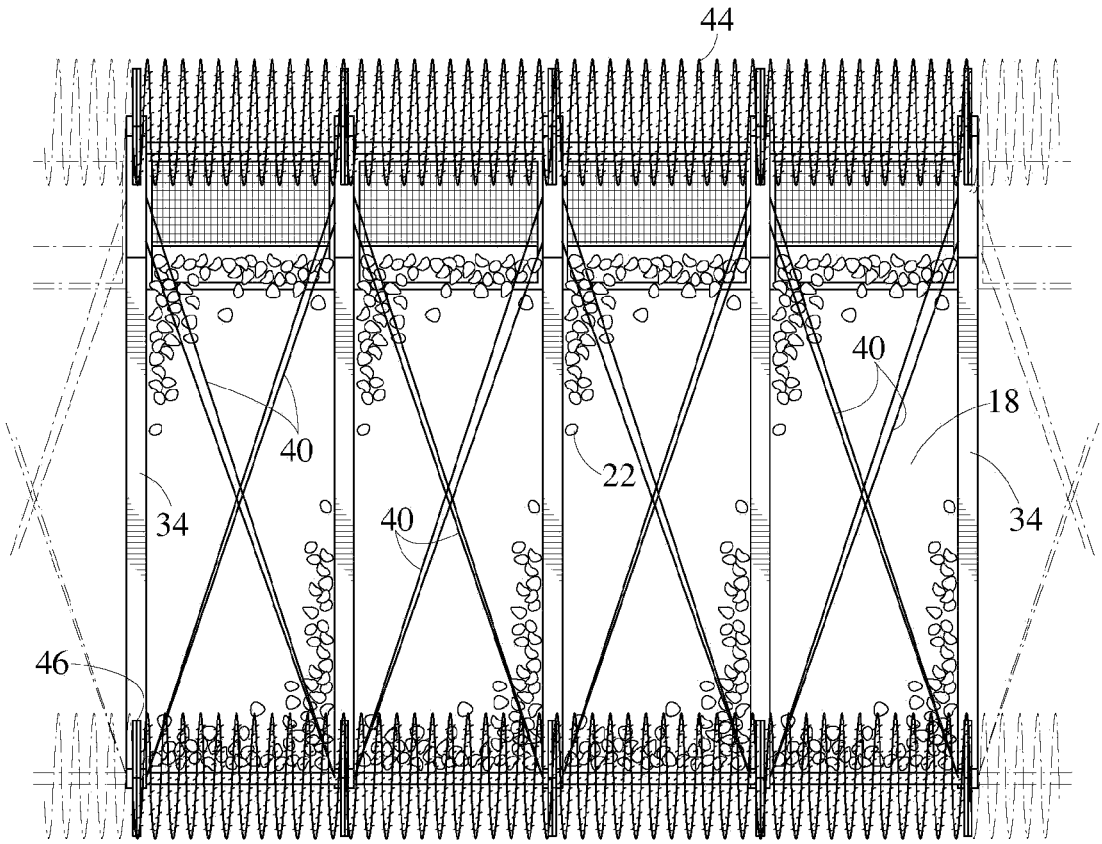
FIG. 4 is a top plan view of the barrier of FIG. 1.

FIGS. 1-4 illustrate a barrier 10 of the present invention which generally includes a connected pair of upstanding and equidistantly spaced first and second walls 12, 14 which together define a channel 16 having an open bottom 18 and an open top 20. (See FIG. 2) Dirt or rock fill 22 (or fill of any other non-vegetative material) is poured into or otherwise placed in the channel between the walls to cover the open bottom of the channel and at least partially fill the channel. As indicated by the outline of the individual 24 of FIG. 2 who has an average height of about 6 feet, the overall height of barrier 10 is about 25 feet and the barrier's channel 16 contains about 6 feet of fill 22. As shown, fill 22 is rock but it could be dirt, gravel or any other non-vegetative material or mixture thereof in accordance with the present invention. The primary requirement of fill 22 is that it have enough weight to prevent the barrier from tipping over and withstand the impact of a vehicle traveling at a high rate of speed.

Those skilled in the art will also appreciate that the design of barrier 10 allows it to be built or placed upon almost any terrain except extremely steep terrain and that the design does not require anchoring or attachment to the ground. The sheer weight of the barrier will in most cases sufficiently immobilize the barrier so as to prevent it from being easily moved by people, even people operating heavy equipment.

As shown, first and second barrier walls 12, 14 respectively include a plurality of upstanding, parallel and spaced I beams 26, 28 which receive a plurality of generally rectangularly shaped mesh panels 30 having mesh 31. Cross beams 32, 34 are also provided which connect each upstanding beam 26 of the first wall to a corresponding upstanding beam 28 of the second wall. The cross beams are preferably welded to the upstanding beams and, as perhaps best shown in FIG. 4, bottom crossbeam 32 connects the bottom edge (not numbered) of upstanding beam 26 of wall 12 to the bottom edge (not numbered) of corresponding upstanding beam 28 of second wall 14. Midsection crossbeam 34 also connects, i.e. is welded to, upstanding beams 26, 28 at pre-determined points on the sides of the beams. As shown and preferred, midsection crossbeam 34 is parallel to the bottom crossbeam 32. As also indicated by the height of individual 24, midsection beam 34 is spaced about 6 feet above the bottom crossbeam 32.

Each connected set of beams, i.e. pair of upstanding beams 26, 28 of the first and second walls which are connected by their respective pair of bottom and midsection beams 32, 34 are referred to herein as a beam section (not numbered). As shown, the connected beams of each beam section lie in the same plane and the beam sections are parallel to and equidistantly spaced from each so that each pair of upstanding beams 26, 28 receives one rectangularly shaped mesh panel 30. The beams, as shown, are preferably I-beams which enable the channels 36 of the I-beams to slidably receive mesh panels 30. While I beams are preferred any type of beam or structural member could be used in accordance with the present invention. Accordingly, as used herein "beam" includes any structural member of any shape as long as the member provides the necessary support. In addition, while mesh is a preferred material for panel 30, panel 30 could be made from a variety of materials such as expanded metal, perforated metal and woven mesh. Solid metal could also be used including sheet metal of virtually any gauge. Concrete panels could also be used as well as panels made from various plastics including composites.

As also shown, the beam sections are held together with cables 40, preferably steel cable, which interconnect the beam sections and prevent them from separating apart. Cables 40 may be tied, welded or bolted to the beams. Cables 40 also make it more difficult for an individual to cross barrier 10 if he or she happens to be able to scale one of the walls 12 or 14. As will be appreciated, an individual having scaled a wall will then have to deal with the aggravation provided by cables 40 in addition to scaling the second wall if he or she is to successfully cross the barrier. Barbed wire and other types of wire could also be strung in channel 16 to further frustrate anyone thinking of crossing the barrier.

In addition, the first six feet (or a pre-determined distance) of the mesh 31 of each mesh panel 30 can be lined on its inside or inner facing surface, as shown, with a geo-textile material 42 to contain the fill, particularly if it is dirt, to prevent it from washing out of the channel 16. Liner could also be attached by simply unrolling a roll of it along the inner facing surfaces of the first and second walls 12, 14 in which case it would cover beams 26, 28 as well as mesh 31 of each panel 30. In addition, if the fill is primarily dirt it may be desirable to install tubing (not shown) at various locations in fill 42 along open bottom 18 to facilitate drainage of the fill.

As shown, concertina 44 as well as barbed wire, razor wire and/or a system of spring-loaded flexible panels may be attached to the top edge (not numbered) of each wall with brackets 46 to make it difficult for individuals to scale or otherwise cross the barrier.

Finally, wall 12 as shown may be inclined at a slight angle to make it more difficult for individuals on the outside of the wall to be able to scale the wall. Wall 12 is also as shown, preferably higher than wall 14 and as such would typically be the outside wall of the barrier or the wall facing or attempting to contain or keep out undesirable individuals.

Figure 5:
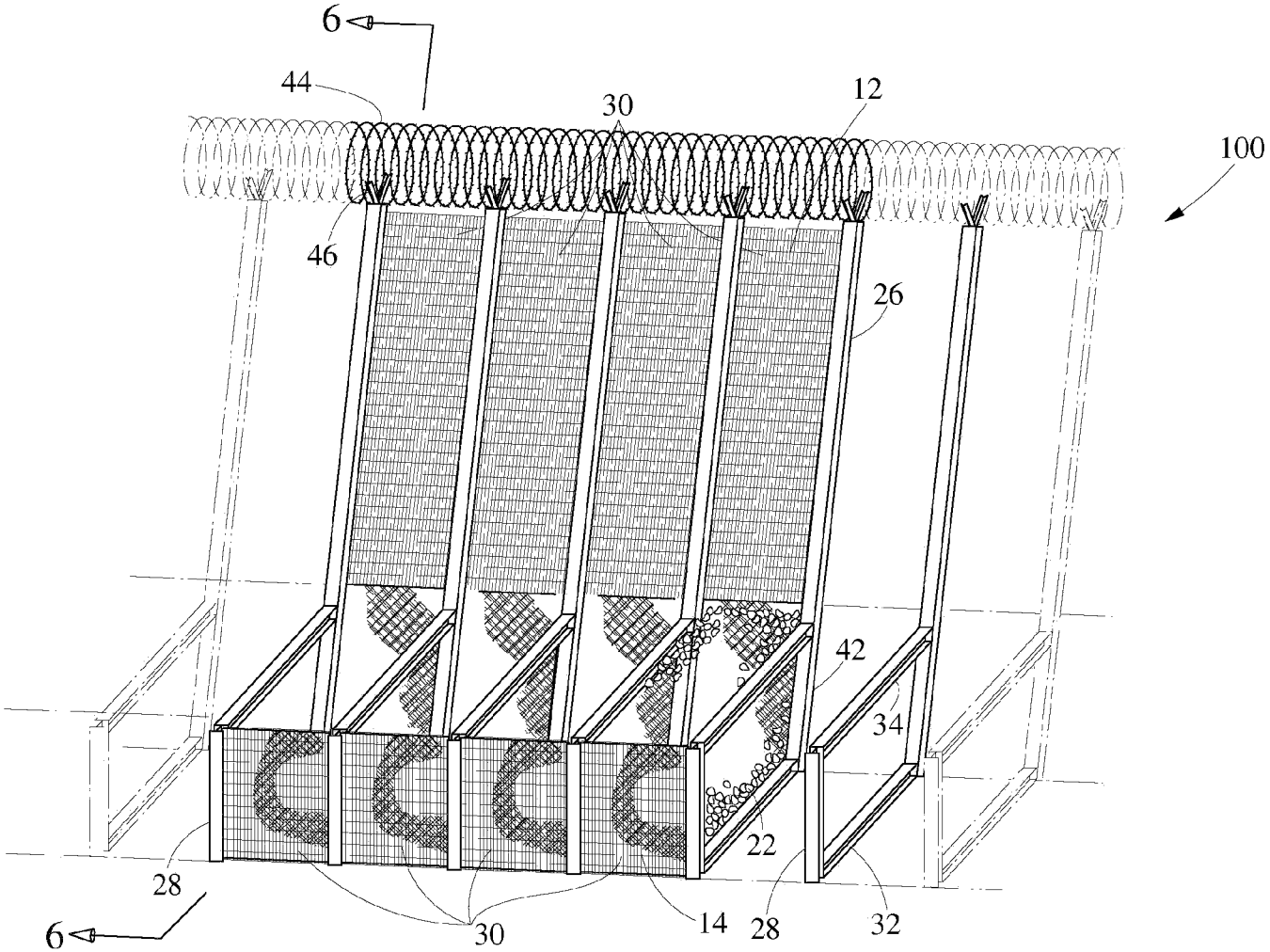
FIG. 5 is a perspective view of another preferred embodiment of the barrier of the present invention.
Figure 6:
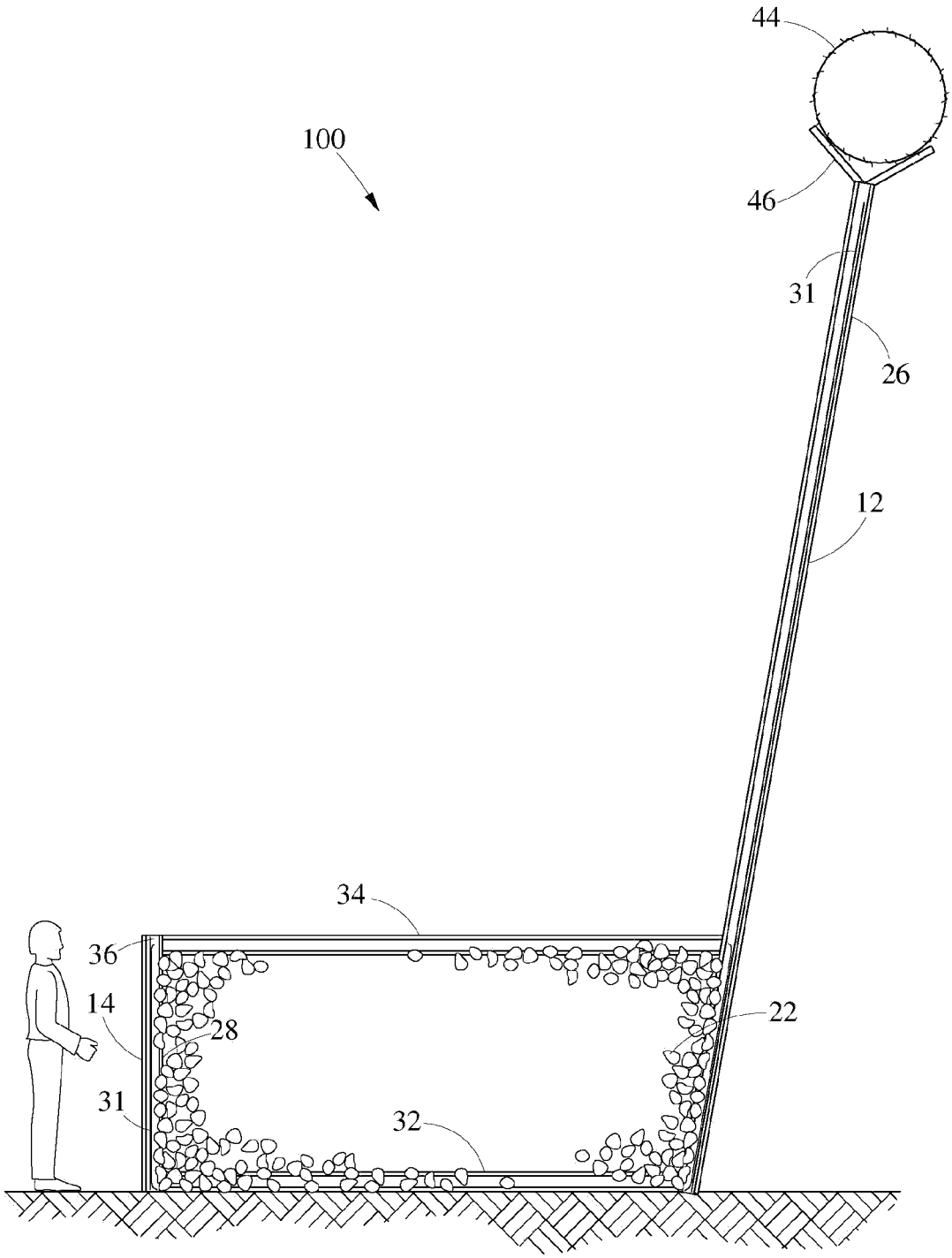
FIG. 6 is a cross-sectional view taken along lines 6-6 of FIG. 5.

FIGS. 5 and 6 illustrate a barrier 100 of the present invention which is very similar to barrier 10 with the exception that wall 14 is no higher than mid-section beam 34. This embodiment would be easier and somewhat less expensive to construct than barrier 10 and may be suitable for some applications where security concerns are not as great but where crowd control is an issue such as at a concert or other music, political or religious event.

The above descriptions should not be construed as limiting the scope of the invention but as mere illustrations of embodiments. Embodiments of the present invention can be applied to a wide variety of uses in a wide range of scale. For example, small scale embodiments approximately six feet in height may be used to fence in animals, such as house cats, that otherwise may be able to scale a conventional fence. At the other end of the spectrum, an international border or prison may be protected using sections of 15 feet or more in height. Oil refineries and power, chemical or treatment plants may also be protected against terrorist attacks with the barrier of the present invention as well as other facilities such as emergency and public health facilities. The scope shall be determined by appended claims as interpreted in light of the above specification.

I claim:

1. A barrier comprising:

a connected pair of upstanding and equidistantly spaced first and second walls which together define a channel having an open bottom and an open top, each said first and second wall including a plurality of upstanding, parallel and spaced beams which receive a plurality of generally rectangularly shaped panels one of said panels being received between each pair of adjacent said upstanding beams of each said wall, said first wall having a bottom edge, a top edge and a pre-determined height, said second wall having a bottom edge, a top edge and a pre-determined height, said upstanding beams of said first wall extending from said bottom edge of said first wall to said top edge of said first wall, said upstanding beams of said second wall extending from said bottom edge of said second wall to said top edge of said second wall and wherein each upstanding beam of said first wall is connected to a corresponding said upstanding beam of said second wall by a plurality of vertically spaced crossbeams, wherein each upstanding beam of said first wall is connected to a corresponding said upstanding beam of said second wall by a bottom crossbeam, wherein all said beams are I-beams having channels and said panels are slidably received in said I-beam channels of said upstanding beams; and, fill covering the open bottom of said channel defined by said upstanding walls and at least partially filling up said channel, said fill being removably retained within said channel by said panels and said bottom crossbeams, said fill being selected from the group consisting of dirt, rocks and other non-vegetative loose ground material.

2. A barrier as claimed in claim 1 wherein each upstanding beam of said first wall is connected at its bottom edge to a said upstanding beam of said second wall at its bottom edge by said bottom crossbeam.

3. A barrier as claimed in claim 2 wherein said crossbeams comprise a plurality of midsection crossbeams, each of which connects a said upstanding beam of said first wall to a said corresponding upstanding beam of said second wall at pre-determined points on the side of said upstanding beams of said first and second walls vertically spaced from a respective said bottom crossbeam.

4. A barrier as claimed in claim 3 wherein said midsection beams are parallel to said bottom crossbeams.

5. A barrier as claimed in claim 3 wherein said corresponding upstanding beams of said first and second walls, said crossbeam and said midsection beam which are connected to each other comprise a beam section and wherein said beams of said beam section all lie in the same plane.

6. A barrier as claimed in claim 5 wherein a plurality of said beam sections of said barrier are parallel to and equidistantly spaced from each other.

7. A barrier as claimed in claim 5 wherein a plurality of said beam sections of said barrier are aligned with and spaced from each other so that said upstanding beams of said first wall are aligned with each other and so that said upstanding beams of said second wall are aligned with each other and so that said each aligned pair of upstanding beams receives one said generally rectangularly shaped panel.

8. A barrier as claimed in claim 7 wherein said beam sections are prevented from separating from each other by cables which interconnect said beam sections.

9. A barrier as claimed in claim 7 wherein said beam sections are interconnected by cables.

10. A barrier as claimed in claim 1 further comprising a member selected from the group consisting of barbed wire, razor wire, concertina and spring-loaded flexible panels attached to said top edge of at least one of said first or second walls.

11. A barrier as claimed in claim 1 further comprising tubing placed in said fill to facilitate drainage of said fill.

12. A barrier as claimed in claim 1 wherein at least one of said walls is inclined so that said walls diverge away from each other as they extend upwardly.

13. A barrier as claimed in claim 1 wherein the predetermined height of said walls is different.

14. A barrier as claimed in claim 1 wherein said panels are mesh panels.

15. A barrier as claimed in claim 1 wherein said panels are made from a material selected from the group consisting of sheet metal, expanded metal, perforated metal and mesh.

16. A barrier as claimed in claim 1 further comprising a lining for covering a pre-determined section of said panels.

17. A barrier as claimed in claim 1 further comprising a lining extending upwardly along an inner facing surface of each said first and second wall a pre-determined distance so as to help contain said fill.

18. A barrier as claimed in claim 17 wherein said lining is made from a geo-textile material.

19. A barrier comprising:

a connected pair of upstanding and equidistantly spaced first and second walls which together define a channel having an open bottom and an open top, each said first and second wall including a plurality of beam sections comprising a plurality of upstanding, parallel and spaced beams which receive a plurality of generally rectangularly shaped panels, one of said panels being received between each pair of adjacent said upstanding beams of each said wall, said first wall having a bottom edge, a top edge and a pre-determined height, said second wall having a bottom edge, a top edge and a pre-determined height;

each said beam section comprising:

a said upstanding beam of said first wall having a bottom edge;

a said upstanding beam of said second wall having a bottom edge;

a bottom crossbeam connecting said bottom edges of corresponding said upstanding beams of said first and second walls; and a midsection beam connecting said corresponding upstanding beams of said first and second walls at pre-determined points on the sides of said upstanding beams vertically spaced from said bottom crossbeam and wherein said corresponding upstanding beams of said first and second walls, said bottom crossbeam and said midsection beam all lie in the same plane and wherein all said beams are I-beams having channels and wherein the panels are slidably receivable in said I-beam channels of said upstanding beams; and fill covering the open bottom of said channel defined by said upstanding walls and at least partially filling up said channel, said fill being removably retained within said channel by said panels and said bottom crossbeams, said fill being selected from the group consisting of dirt, rocks and other non-vegetative loose ground material.

20. A barrier as claimed in claim 19 wherein within each said beam section said midsection beam is parallel to said bottom crossbeam.

* * * * *